US009828946B2

(12) United States Patent
Shebuski

(10) Patent No.: US 9,828,946 B2
(45) Date of Patent: Nov. 28, 2017

(54) CARBURETOR WITH ONE PIECE CHOKE VALVE AND SHAFT ASSEMBLY

(71) Applicant: USA ZAMA INC., Franklin, TN (US)

(72) Inventor: David R. Shebuski, Franklin, TN (US)

(73) Assignee: USA ZAMA INC., Franklin, TN (US)

( * ) Notice: Subject to any disclaimer, the term of this patent is extended or adjusted under 35 U.S.C. 154(b) by 69 days.

(21) Appl. No.: 15/071,747

(22) Filed: Mar. 16, 2016

(65) Prior Publication Data

US 2017/0022936 A1 Jan. 26, 2017

Related U.S. Application Data

(63) Continuation of application No. 14/245,467, filed on Apr. 4, 2014, now Pat. No. 9,316,176, which is a continuation of application No. 12/979,801, filed on Dec. 28, 2010, now Pat. No. 8,695,952.

(51) Int. Cl.
*F02M 1/02* (2006.01)
*F02M 7/24* (2006.01)

(52) U.S. Cl.
CPC ..... *F02M 7/24* (2013.01); *F02M 1/02* (2013.01)

(58) Field of Classification Search
CPC ..... F02M 1/02; B01F 3/04
USPC ..... 261/52, 64.1, 64.3, 64.4, 65
See application file for complete search history.

(56) References Cited

U.S. PATENT DOCUMENTS

| | | | |
|---|---|---|---|
| 2,547,873 | A | 4/1951 | Kittler |
| 3,906,911 | A | 9/1975 | Nakada et al. |
| 6,202,989 | B1 | 3/2001 | Pattullo |
| 6,439,547 | B1 | 8/2002 | King et al. |
| 6,561,496 | B2 | 5/2003 | Gliniecki et al. |
| 7,404,546 | B2 | 7/2008 | Prager et al. |
| 7,427,057 | B1 | 9/2008 | Kampman et al. |
| 7,523,922 | B2 | 4/2009 | Shebuski |
| 2002/0109244 | A1 | 8/2002 | Nickel |

FOREIGN PATENT DOCUMENTS

| | | |
|---|---|---|
| JP | 59-5865 | 1/1984 |

*Primary Examiner* — Robert A Hopkins
(74) *Attorney, Agent, or Firm* — One LLP

(57) ABSTRACT

A carburetor including a one piece choke valve and shaft assembly including a shaft, a detent plate formed on a first end, a lever arm formed on a second end, a pair of opposing collars formed adjacent the detent plate and lever arm, a valve plate centrally positioned on the shaft, and opposing splines formed on the shaft enabling it to be inserted through an assembly slot cut into a shaft bore in the carburetor body. The detent plate includes a partial annular slot encompassing the angular range of travel of the choke valve. First, second and third detent pockets are formed along an outer edge of the slot. A positive positioning pin engages or interacts with the detent plate to positively position the choke valve in first, second or third angular positions corresponding to "close choke", "half choke" and "open choke."

10 Claims, 7 Drawing Sheets

CARBURETOR WITH ONE PIECE CHOKE VALVE AND SHAFT ASSEMBLY

CROSS-REFERENCE TO RELATED APPLICATIONS

The present application is a continuation application of U.S. patent application Ser. No. 14/245,467 filed Apr. 4, 2014, which claims priority to U.S. patent application Ser. No. 12/979,801 filed Mar. 5, 2012, now U.S. Pat. No. 8,695,952, which is hereby incorporated by reference in its entirety.

FIELD OF THE INVENTION

The embodiments described herein relate to a carburetor and, more particularly to a carburetor with a one piece choke valve and shaft assembly.

BACKGROUND OF THE INVENTION

In a typical carburetor having a choke valve, a choke valve shaft bore is machined through the body of the carburetor passing through a choke valve bore in an intake air passageway extending through the body. To assemble the choke valve in the carburetor, the choke valve shaft is inserted through the shaft bore and then the choke valve is coupled to the choke shaft in the choke valve bore in the intake air passage. A lever arm is attached to one end of the shaft and a retaining means is attached to the other end of the shaft.

It is desirable to provide a choke valve and shaft assembly that eliminates the multi-step assembly process for the choke valve and shaft assembly.

SUMMARY OF THE INVENTION

The embodiments described herein provide a carburetor with a one piece choke valve and shaft assembly and a choke valve positive positioning system. The carburetor includes choke valve and shaft that are preferably formed as a single piece plastic injection molded part. The one piece choke valve and shaft assembly preferably includes a choke valve shaft, a detent plate of the positive positioning system formed on a first end of the choke valve shaft, a choke valve shaft lever arm formed on and extending from a second end of the choke valve shaft, a pair of opposing first and second collars having a slightly larger diameter than the choke valve shaft and formed adjacent the detent plate and choke valve lever arm, and a generally oval choke valve plate centrally positioned along the shaft. First and second sets of opposing flat splines are formed on the choke valve shaft enabling the choke valve shaft to be inserted through an assembly slot cut through the body into a shaft bore, which is machined through the body passing through a choke valve bore of an air intake passageway.

The detent plate has a generally rounded sector of a circle shaped profile with a main body or hub portion, a partial annular wing or outer portion extending radially from the hub portion, and a partial annular slot cut through the partial annular wing. The angular distance along the slot encompasses the angular distance or range of travel of the choke valve. First, second and third detent pockets are formed along the outer edge of the slot. A positive positioning pin engages or interacts with the detent plate to positively position the choke valve in first, second or third angular positions corresponding to "close choke", "half choke" and "open choke."

Further, objects and advantages of the invention will become apparent from the following detailed description.

DETAILED DESCRIPTION OF THE PREFERRED EMBODIMENTS

Figure 1:
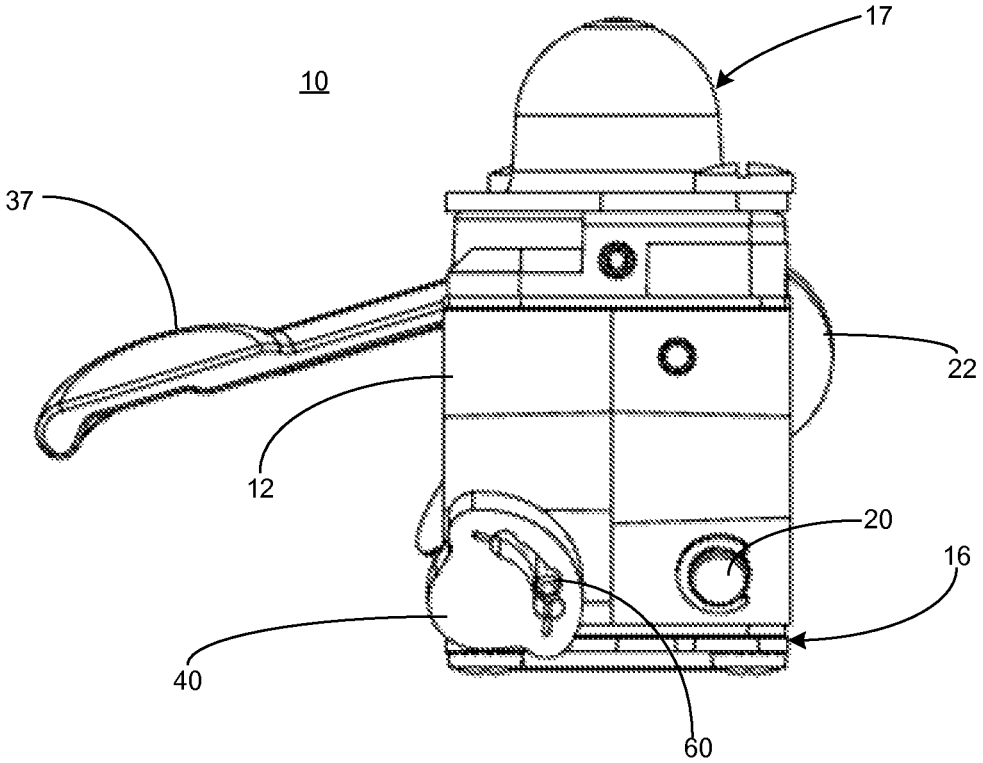
FIG. 1 is an end view of an embodiment of a carburetor with a one piece choke valve assembly and positive positioning system.
Figure 2:
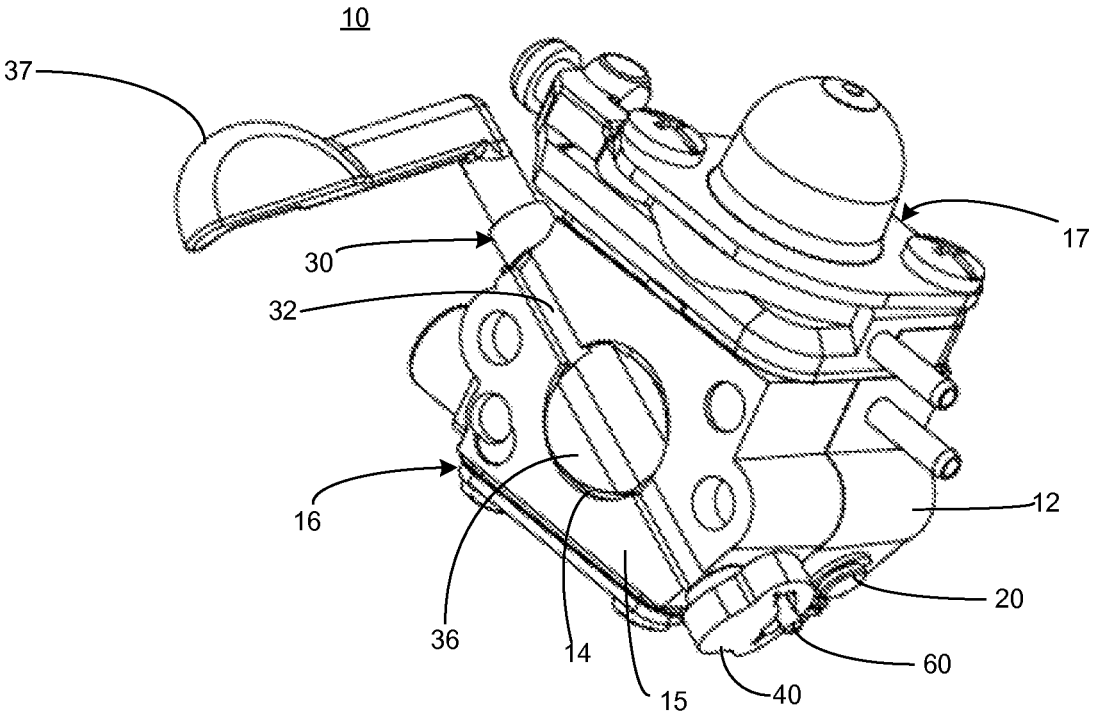
FIG. 2 is a perspective view of the carburetor in FIG. 1.

Embodiments are described below with reference to the drawings. FIGS. 1 and 2 are end and perspective views, respectively, of a carburetor 10 comprising a body 12. The carburetor body 12 has an air intake passageway 14 extending from a side face 15 through the body 12 of the carburetor 10 for feeding an air/fuel mixture to an engine (not shown). A diaphragm type constant fuel chamber 16 is formed on the lower face of the body 12 and a primer pump system 17 is formed on the upper face of the body 12. As shown in FIGS. 2, 4, 13, 17, 20, and 23, the intake passageway 14 has, in order from the inlet 11 (or choke side) to the outlet 13, a choke bore 18, a choke valve 36 positioned within the choke bore 18 and integrally formed with a choke shaft 32 rotatably mounted in the body 12, a venturi 24 extending from the choke bore 18, a throttle bore 26 extending from the venturi 24, and a throttle valve 28 positioned within the throttle bore 24 and coupled to a throttle shaft 20 rotatably mounted in the body 12. A throttle valve lever 22 is fixedly mounted to the end of the throttle valve shaft 20 protruding from the body 12 and a choke valve lever 37 extends from one end of the choke valve shaft 32. As discussed in greater detail below, the carburetor 10 includes a choke valve positive positioning system including a choke valve detent plate 40 positioned at an end of the choke valve shaft 32 opposite the choke valve lever 37. The detent plate 40 interacts with a positioning pin 60 extending from the body 12 to positively position the choke valve 36. Although shown as extending from the body 12 of the carburetor 10, the pin 60 can be supplied as extending from another component of the carburetor 10. The size and shape of the detent plate 40 would be adapted to accommodate such a pin 60.

Figure 3:
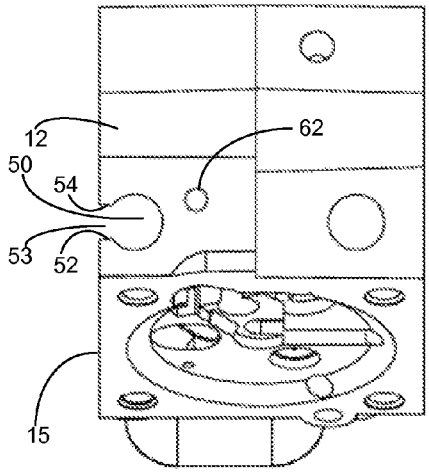
FIG. 3 is an end view of the carburetor in FIG. 1 less the one piece choke valve and shaft assembly and positive positioning system and taken along the axis of a choke valve shaft bore.
Figure 4:
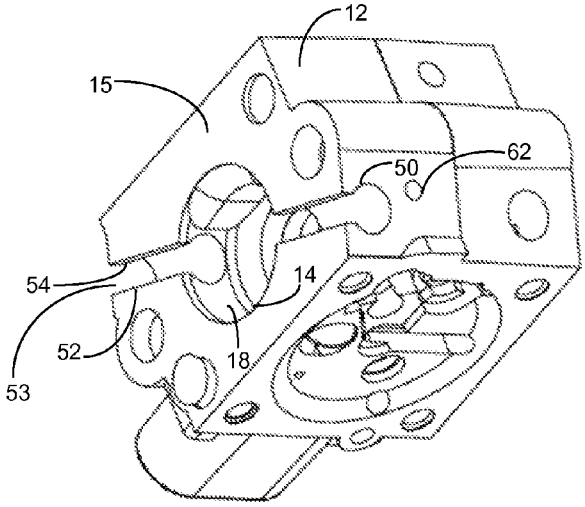
FIG. 4 is a perspective view of the carburetor in FIG. 1 less the one piece choke valve and shaft assembly and positive positioning system.

As shown in FIGS. 3 and 4, a choke valve shaft bore 50 is machined through the body 12 of the carburetor 10 passing through the choke valve bore 18 of the intake passageway 14. An assembly slot 53 bounded by edges or shoulders 52 and 54 and having a width smaller than the diameter of the bore 50 is cut into the body 12 along the length of the bore 50 and extending from the side face 15 of the body 12 of the carburetor 10 into the bore 50.

Figure 5:
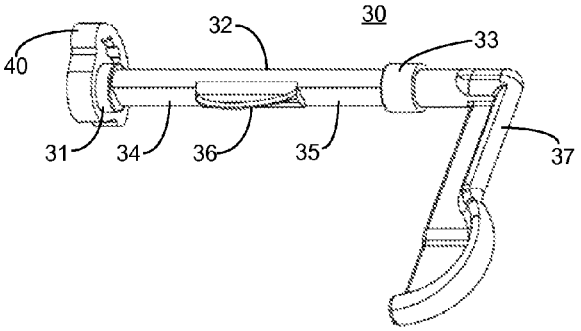
FIG. 5 is a perspective view of the one piece choke valve and shaft assembly.
Figure 6:
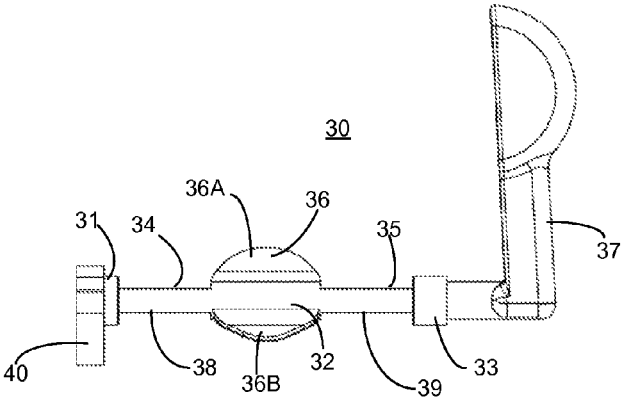
FIG. 6 is a plan view of the one piece choke valve and shaft assembly.
Figure 17:
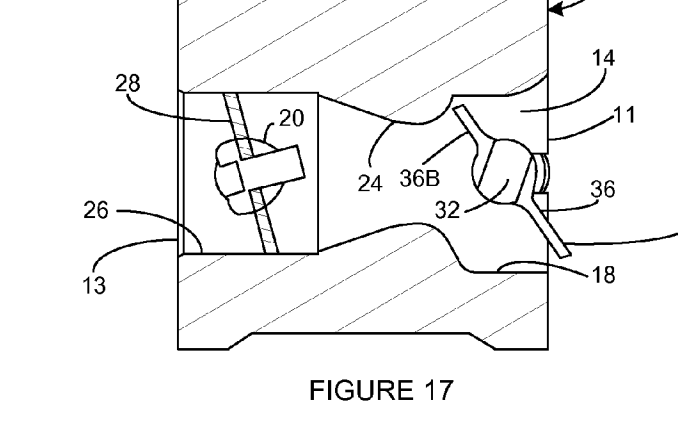
FIG. 17 is a sectional view of the carburetor in FIG. 15 taken along line 17-17.
Figure 20:
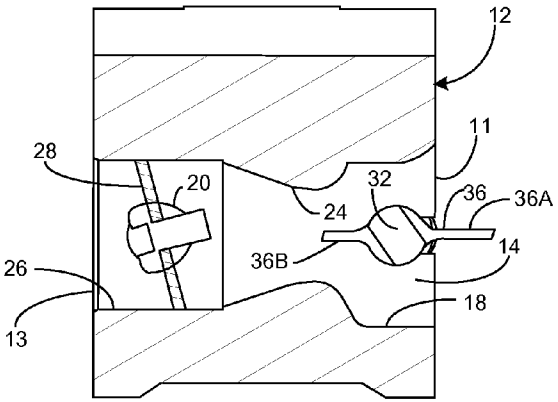
FIG. 20 is a sectional view of the carburetor in FIG. 19 taken along line 20-20.
Figure 23:
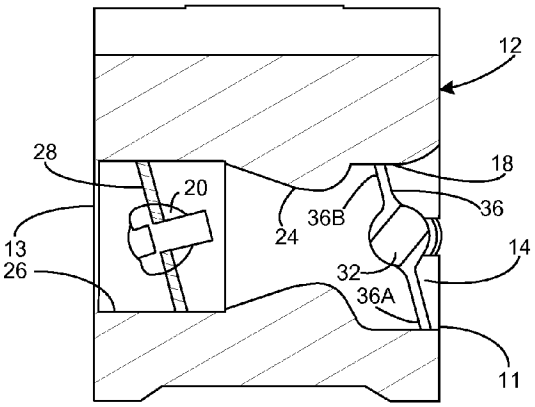
FIG. 23 is a sectional view of the carburetor in FIG. 22 taken along line 23-23.

Turning to FIGS. 5 and 6, a choke valve and shaft assembly 30 is shown. The choke valve and shaft assembly 30 is preferably formed as a single piece plastic injection molded part. As noted above, the assembly 30 includes a choke valve shaft 32, a detent plate 40 formed on a first end of the choke valve shaft 32, a choke valve shaft lever arm 37 formed on and extending from a second end of the choke valve shaft 32, a pair of opposing first and second collars 31 and 33 having a slightly larger diameter than the choke valve shaft and formed adjacent the detent plate 40 and choke valve lever arm 37, and a generally oval choke valve plate 36 centrally positioned along the shaft 32. The choke valve plate 36 being oriented asymmetrically relative to the axis of the shaft 32 with a leading end portion 36A being longer than a trailing end portion 368 as shown in FIGS. 17, 20 and 23.

A first set of opposing flat splines 34 and 38 are formed on the choke valve shaft 32 between the first collar 31 and the choke valve plate 36. A second set of opposing flat splines 35 and 39 are formed on the choke valve shaft 32 between the second collar 33 and the choke valve plate 36. The thickness of the choke valve shaft 32 between the opposing splines 34 and 38, and 35 and 39, is less than the diameter of the rounded portion of choke valve shaft 32.

Figure 7:
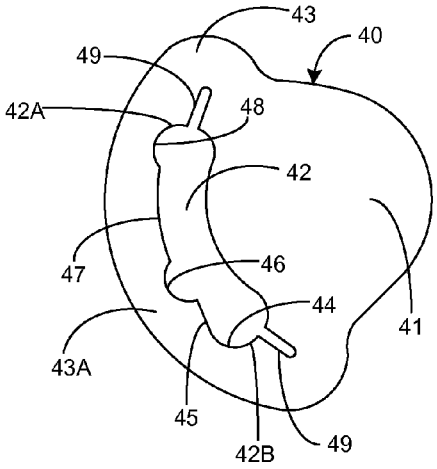
FIG. 7 is a plan view of a detent plate.

As depicted in FIG. 7, the detent plate 40 has a generally rounded sector of a circle shaped profile with a main body or hub portion 41 and a partial annular wing or outer portion 43 extending radially from the hub portion 41. A partial annular slot 42 is cut through the outer portion 43 of the detent plate 40 at a position radially spaced from the center of the hub portion 41. The angular distance along a radial axis of the slot 42 between the first and second ends 42A and 428 of the slot 42 encompasses the angular distance or range of travel of the choke valve 36.

A pair of slits 48 and 49 extend from the first and second ends 42A and 428 of the slot 42 and are cut through the outer portion 43 of the detent plate 40. The slits 48 and 49 allow an outer partial annular rim portion 43A to deflect or flex outwardly from the hub portion 41.

Formed along the outer edge of the slot 42 are first, second and third detent pockets 44, 46 and 48. The outer edge of the slot 42 between the first and second detent pockets 44 and 46 forms an inclined straight cam surface 45 and between the second and third detent pockets 46 and 48 forms a curved cam surface 47 of constant radius.

A positive positioning pin 60, as shown in FIG. 1, engages or interacts with the detent plate 40 to positively position the choke valve 36 in first, second or third angular positions corresponding to "close choke", "half choke" and "open choke." As the choke valve 36 is rotated from a first position (closed choke position) in which the pin 60 is received in the first detent pocket 44 to a second position (half choke position) wherein the pin is received in the second detent pocket 46, the pin 60 engages the inclined cam surface 45. As the detent plate 40 rotates, pressure applied by the pin 60 to the inclined cam surface 45 causes the rim 43A to flex or deflect outwardly and resiliently flex or snap back to its original orientation as the pin 60 moves past the end of the cam surface 45 and is received in the second detent pocket 46. Similarly, as the choke valve 36 is rotated from the second position (half choke position) in which the pin 60 is received in the second detent pocket 46 to a third position (open choke) wherein the pin 60 is received in the third detent pocket 48, the pin 60 engages the curved cam surface 47. As the detent plate 40 rotates, pressure applied by the pin 60 to the curved cam surface 47 causes the rim 43A to flex or deflect outwardly and resiliently flex or snap back to its original orientation as the pin 60 moves past the end of the cam surface 47 and is received in the detent pocket 48.

When in the first or closed choke position, the interaction between the pin 60 and the inclined cam surface 45 biases the choke valve shaft 32 to rotate towards the closed choke or first position to ensure the pin 60 stays in the first detent pocket 44 and retains the choke valve 36 in the closed position.

Figure 8:
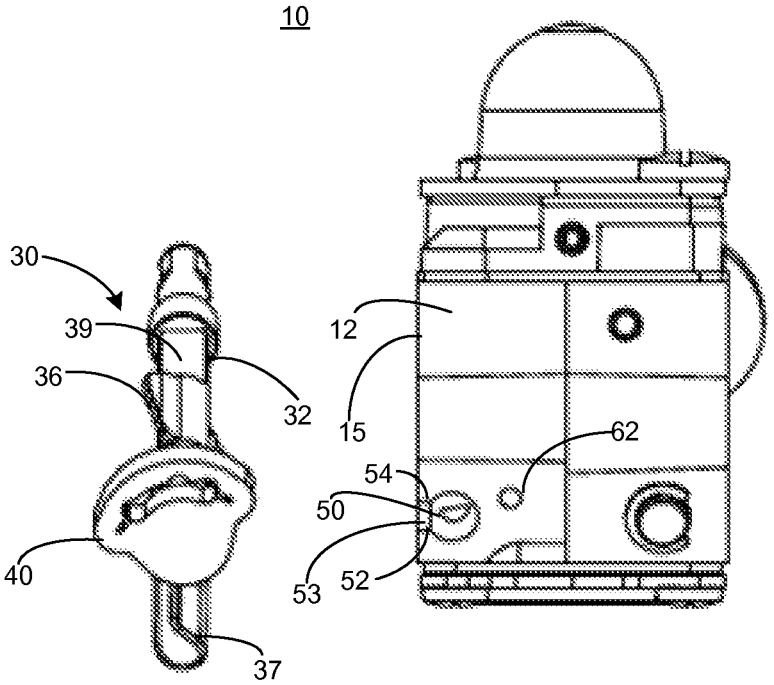
FIG. 8 is an exploded assembly end view of the carburetor in FIG. 1 with the one piece choke valve and shaft assembly oriented for assembly into the choke valve shaft bore in the body of the carburetor.
Figure 9:
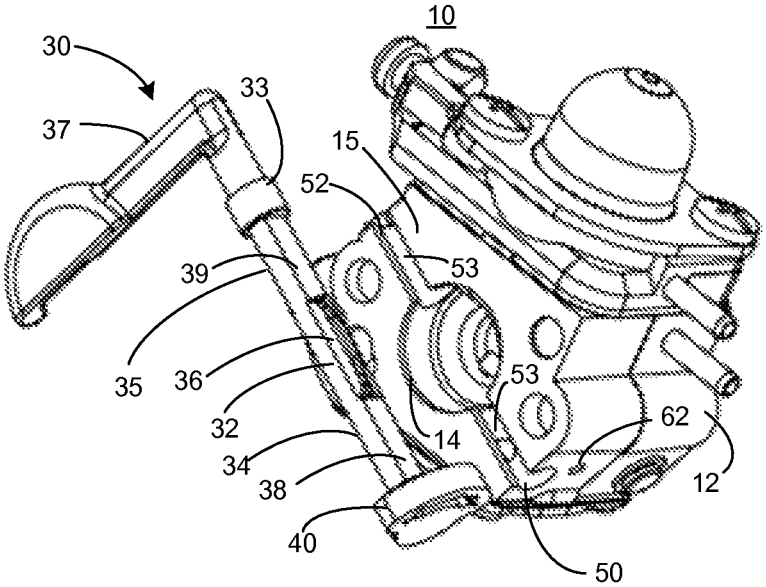
FIG. 9 is a exploded assembly perspective view of the carburetor in FIG. 1 with the one piece choke valve and shaft assembly oriented for assembly into the choke valve shaft bore in the body of the carburetor.

Turning to FIGS. 8 and 9, the choke valve and shaft assembly 30 is shown oriented relative to the slot 53 in the body 12 of the carburetor 10 to be assembled into the body 12 of the carburetor 10. As shown, the opposing splines 34 and 38, and 35 and 39, on the choke valve shaft 32 are aligned with the slot 53 to enable the choke valve shaft 32 to pass the edges or shoulders 52 and 54 of the slot 53.

Figure 11:
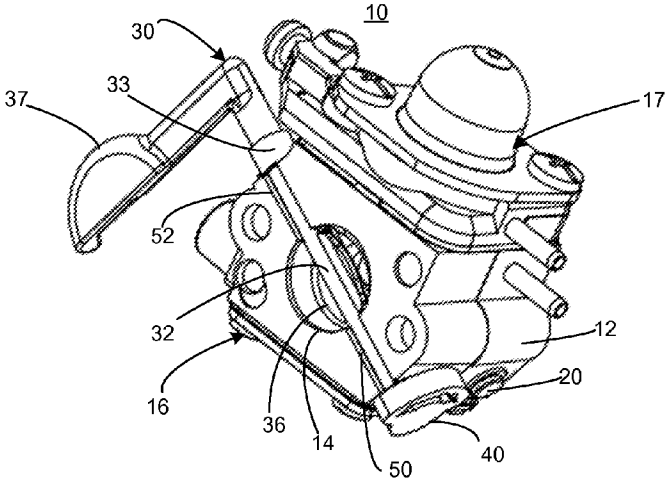
FIG. 11 is a frontal perspective view of the carburetor in FIG. 1 with the one piece choke valve and shaft assembly mounted in the choke valve shaft bore in the initial assembled orientation.
Figure 13:
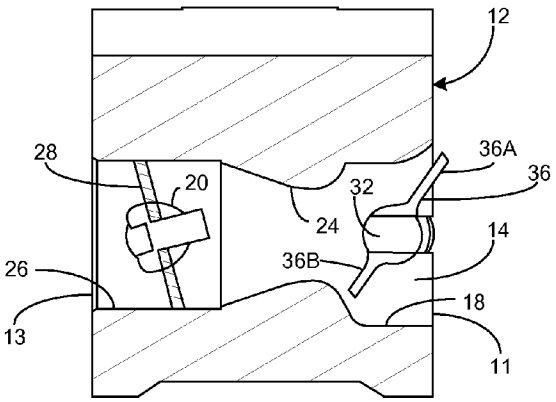
FIG. 13 is a sectional view of the carburetor in FIG. 11 taken along line 13-13.
Figure 10:
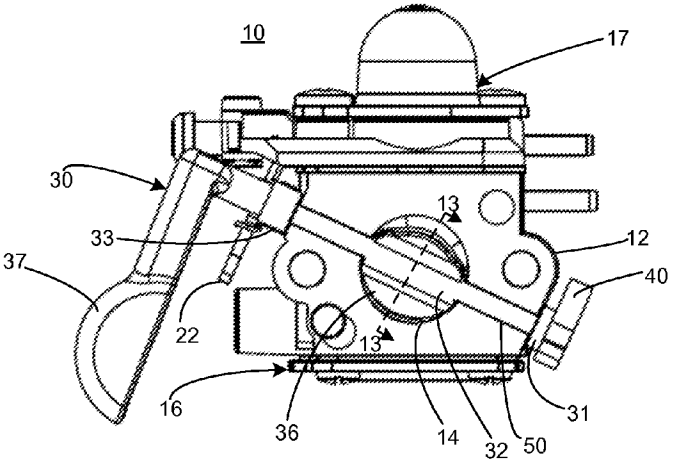
FIG. 10 is a front view of the carburetor in FIG. 1 with the one piece choke valve and shaft assembly mounted in the choke valve shaft bore in the initial assembled orientation.
Figure 12:
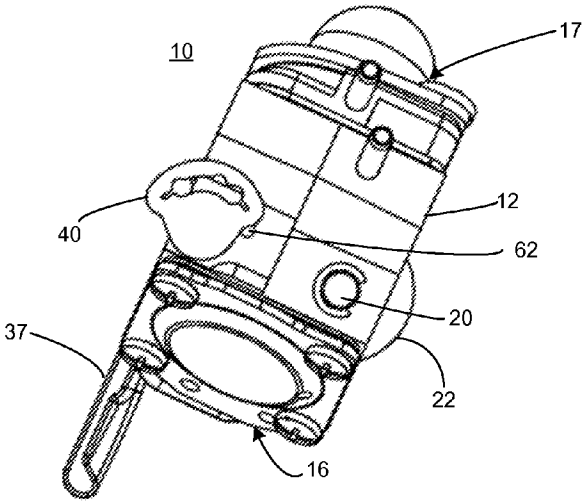
FIG. 12 is an end perspective view of the carburetor in FIG. 1 with the one piece choke valve and shaft assembly mounted in the choke valve shaft bore in the initial assembled orientation.

FIGS. 10, 11 and 12 show the choke valve and shaft assembly 30 assembled within body 12 of the carburetor 10. As depicted, the choke valve shaft 32 is positioned within the choke valve shaft bore 50 with the collars 31 and 33 abutting the end faces of the body 12 of the carburetor 10. As shown in detail in FIG. 13, in the initial assembled position, the choke valve 36 is oriented with its leading end portion 36A pointing upwardly and out of the intake passageway 14, with the trailing end portion 368 pointing downwardly and inwardly into the intake passageway 14. As depicted in FIG. 12, the position pin mounting hole 62 is positioned outside the periphery of the detent plate 40.

Figure 14:
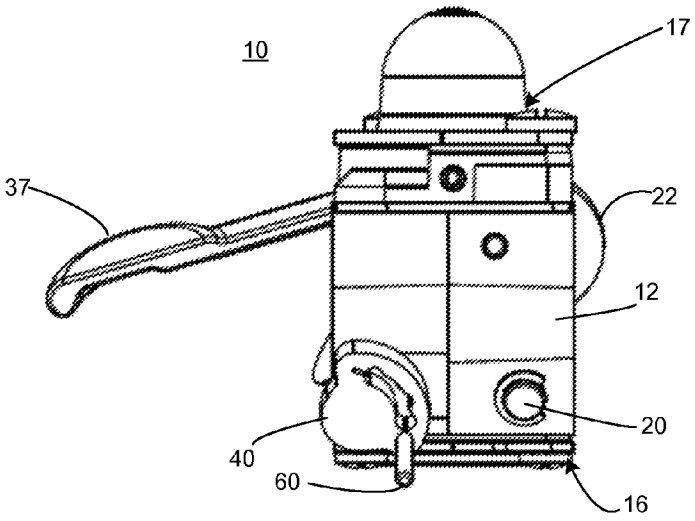
FIG. 14 is an exploded assembly end view of the carburetor in FIG. 1 with the one piece choke valve and shaft assembly mounted in the choke valve shaft bore in the half choke orientation and a position pin oriented to be mounted in the body of the carburetor and positioned within the second detent pocket of the detent plate.
Figure 15:
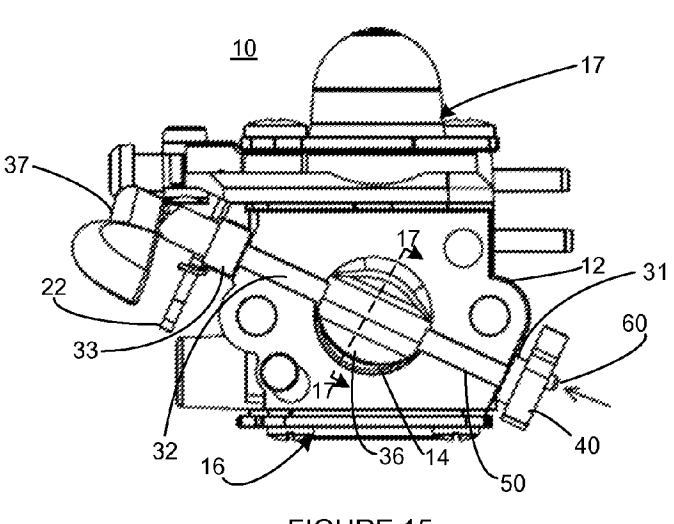
FIG. 15 is a front view of the carburetor in FIG. 1 with the one piece choke valve and shaft assembly mounted in the choke valve shaft bore in the half choke orientation.
Figure 16:
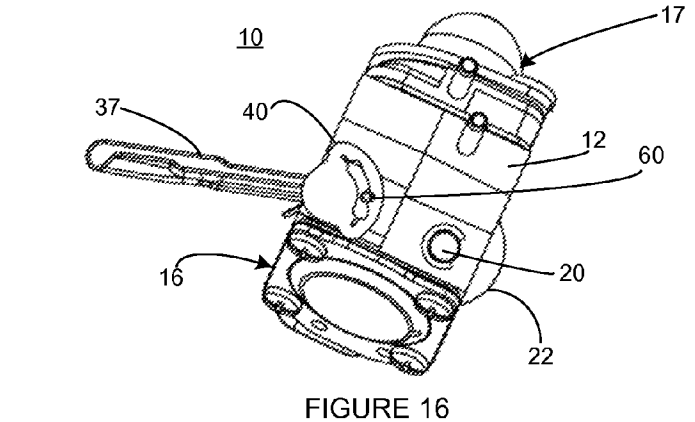
FIG. 16 is an end perspective view of the carburetor in FIG. 1 with the one piece choke valve and shaft assembly mounted in the choke valve shaft bore in the half choke orientation.

In order to secure the choke valve shaft 32 within the choke shaft valve bore 50, the choke valve 36 is, as depicted in FIG. 17, rotated clockwise to the half choke position where the leading end portion 36A is pointing downwardly and outwardly from the intake passageway 14 and the trailing end portion 368 upwardly and inwardly into the intake passageway 14. As shown in FIGS. 14, 15 and 16, with the second detent pocket 46 of the detent plate 40 aligned with the position pin hole 62, the position pin 60 is inserted past the detent plate 40 and pushed into the position pin hole 62 in the body 12 of the carburetor 10. Preferably, when the choke valve 36 is in the half choke position, the position pin 60 is not in interference with the detent plate 40. The position pin 60 preferably has an interference fit with the detent plate 40 when in the first and third detent pockets 44 and 48 and when engaged with cam surfaces 45 and 47.

With the position pin 60 in place, rotation of the choke valve shaft 32 is limited to the angular range of the slot 42 of the detent plate 40 and, thus, prevented from rotating to a position in which the splines 34 and 38, and 35 and 39, on the choke valve shaft 32 align with the slot 53. As result, the choke valve shaft 32 can not be removed from the bore 50 through the assembly access slot 53 when the position pin 60 is mounted in place within the position pin hole 62 of the body 12 of the carburetor 10 and extending into the annular slot 42 of the detent plate 40.

In operation, when the choke valve 36 is rotated to the half choke position from either closed choke or open choke positions, the position pin 60 travels along the inclined cam surface 45 or arcuate cam surface 47 until the position pin 60 is received in the second detent pocket 46 positively releaseably locking the choke valve 36 into the half choke position.

Figure 18:
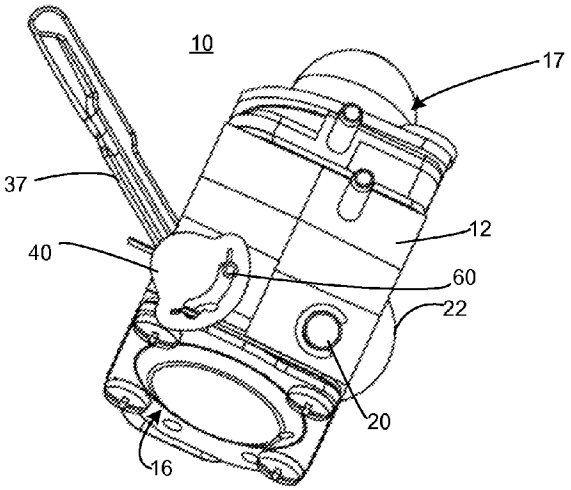
FIG. 18 is an end perspective view of the carburetor in FIG. 1 with the one piece choke valve and shaft assembly mounted in the choke valve shaft bore in the open choke orientation.
Figure 19:
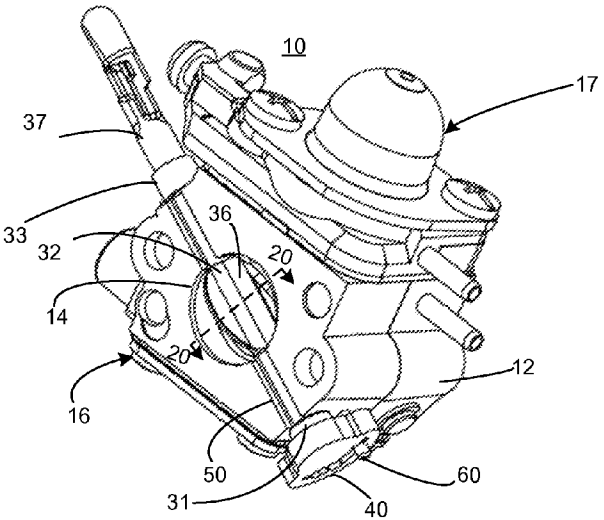
FIG. 19 is a frontal perspective view of the carburetor in FIG. 1 with the one piece choke valve and shaft assembly mounted in the choke valve shaft bore in the open choke orientation.

FIGS. 18, 19 and 20 show the choke valve 36 rotated counter clockwise from the half choke position shown in FIG. 17 to an open choke position wherein the leading end portion 36A is pointing horizontally along the axis of the intake passageway 14 and outwardly from the intake passageway 14, and the trailing end portion 368 is pointing horizontally along the axis of the intake passageway 14 and inwardly into the intake passageway 14. When the choke valve 36 is rotated to the open choke position form the half choke position, the position pin 60 travels along the arcuate cam surface 47 until the position pin 60 is received in the third detent pocket 48 positively releaseably locking the choke valve 36 into the open choke position.

Figure 21:
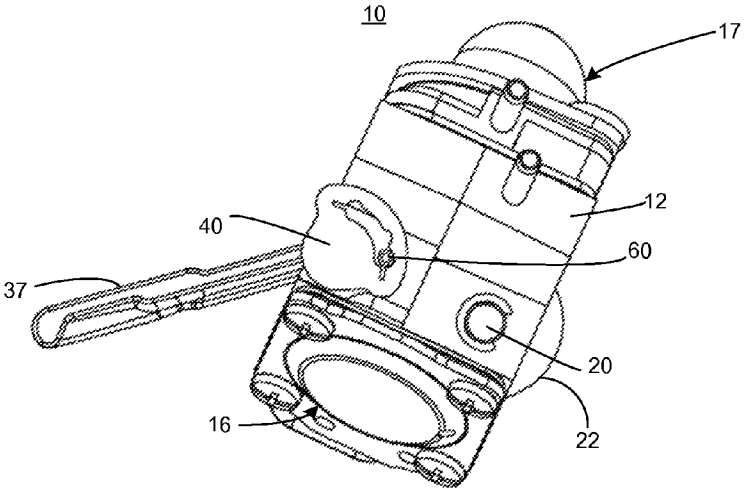
FIG. 21 is an end perspective view of the carburetor in FIG. 1 with the one piece choke valve and shaft assembly mounted in the choke valve shaft bore in the closed choke orientation.
Figure 22:
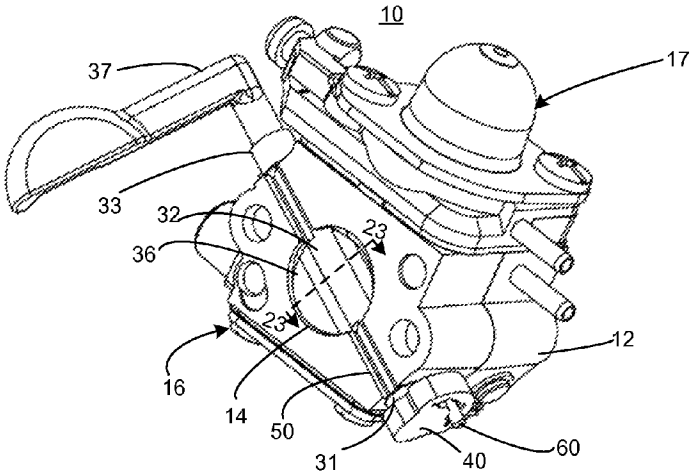
FIG. 22 is a frontal perspective view of the carburetor in FIG. 1 with the one piece choke valve and shaft assembly mounted in the choke valve shaft bore in the closed choke orientation.

FIGS. 21, 22 and 23 show the choke valve 36 rotated clockwise from the half choke position shown in FIG. 17 or open choke position shown in FIG. 20 to a closed choke position wherein the leading end portion 36A is pointing downwardly toward the opening of the intake passageway 14 and the trailing end portion 368 is pointing upwardly and inwardly into the intake passageway 14. When the choke valve 36 is rotated to the closed choke position, the position pin 60 travels along the inclined cam surface 45 until the position pin 60 is received in the first detent pocket 48 positively releaseably locking the choke valve 36 into the open choke position. As noted above, when in the closed choke position, the interaction between the position pin 60 and the inclined cam surface 45 biases the choke valve shaft 32 to rotate towards the closed choke position to ensure the pin 60 stays in the first detent pocket 44 and retains the choke valve 36 in the closed position.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A carburetor comprising a body having an air intake passageway extending therethrough, a shaft bore machined through the body and opening into the air intake passageway, and a one piece choke valve and shaft assembly releasably positioned within the shaft bore and the air intake passageway, wherein the one piece choke valve and shaft assembly includes a choke valve shaft and first and second sets of opposing flat splines formed on the choke valve shaft enabling the choke valve shaft to be inserted through an assembly slot cut through the body into the shaft bore.

2. The carburetor of claim 1 wherein the one piece choke valve and shaft assembly further comprises a choke valve plate, wherein the choke valve plate and the choke valve shaft comprising a single piece construction.

3. The carburetor of claim 2 further comprising a choke valve positive positioning system operably coupled to the choke valve.

4. The carburetor of claim 3 wherein the one piece choke valve and shaft assembly further includes a detent plate of the positive positioning system formed on a first end of the choke valve shaft and a choke valve shaft lever arm formed on and extending from a second end of the choke valve shaft.

5. The carburetor of claim 4 wherein the one piece choke valve and shaft assembly further includes a pair of opposing first and second collars having a diameter than the choke valve shaft and formed adjacent the detent plate and choke valve lever arm.

6. The carburetor of claim 4 wherein the detent plate is configured to operably engage a positioning pin coupled to the body of the carburetor.

7. The carburetor of claim 6 wherein the detent plate has a generally rounded sector of a circle shaped profile with a hub portion, a partial annular wing or outer portion extending radially from the hub portion, and a partial annular slot cut through the partial annular wing.

8. The carburetor of claim 7 wherein the angular distance along the slot encompasses the angular range of travel of the choke valve.

9. The carburetor of claim 8 wherein the slot includes first, second and third detent pockets formed along an outer edge.

10. The carburetor of claim 9 wherein the detent plate is configured to operably engage a positive positioning pin to positively position the choke valve in first, second or third angular positions of the first, second and third detent pockets corresponding to "close choke", "half choke" and "open choke".

* * * * *